US006151857A

United States Patent [19]

Raschke

[11] Patent Number: 6,151,857

[45] Date of Patent: Nov. 28, 2000

[54] PREFABRICATED COMPOSITE CONSTRUCTION SYSTEM FOR INTERNAL AND/OR EXTERNAL BUILDING-WALLS

[75] Inventor: Gabriele Raschke, Dessau, Germany

[73] Assignee: Pieces, LLC, Melbourne Beach, Fla.

[21] Appl. No.: 09/264,144

[22] Filed: Mar. 5, 1999

[51] Int. Cl.[7] ..... E04B 2/28

[52] U.S. Cl. ..... 52/426; 52/425; 52/424; 52/431

[58] Field of Search ..... 52/426, 425, 424, 52/431, 565

[56] References Cited

U.S. PATENT DOCUMENTS

| | | | |
|---|---|---|---|
| 2,029,082 | 1/1936 | Odam | 52/426 X |
| 2,316,668 | 4/1943 | Bronner | 52/424 X |
| 4,655,014 | 4/1987 | Krecke | 52/426 X |
| 4,669,234 | 6/1987 | Wilnau | 52/426 X |
| 4,765,109 | 8/1988 | Boeshart | 52/426 |
| 5,107,648 | 4/1992 | Roby | 52/426 X |
| 5,570,552 | 11/1996 | Nehring | 52/426 |
| 5,735,093 | 4/1998 | Grutsch | 52/565 X |
| 5,809,725 | 9/1998 | Cretti | 52/426 |

*Primary Examiner*—Carl D. Friedman
*Assistant Examiner*—Phi Dieu Tran A
*Attorney, Agent, or Firm*—Notaro & Michalos P.C.

[57] ABSTRACT

The invention concerns a prefabricated composite construction system for the production of internal and/or external building-walls. The composite construction system has a building panel for internal use of wooden material and a building panel for external use of a heat-insulating hard cellular material. Between the panels spacers are provided which are connected with them and form voids, which can be filled with concrete, in which steel lattices are arranged on the building panel for internal use which extend in concrete chuting direction. For increasing the prefabricated composite construction system's bending tension strength, a wooden material panel is provided between the spacers, arranged in each case in a row, and the building panel for external use which wooden material panel is firmly fixed by means of bondings to both, the building panel for external use and the bearing area of each of the allocated spacers facing the building panel for external use and which wooden material panel has a width of at least double the size of the largest dimension of the bearing area of each spacer. At the same time, every steel lattice is, by means of many clamp-like fixing elements, which are in a distance to each other, firmly fixed to the building panel for internal use.

7 Claims, 4 Drawing Sheets

PREFABRICATED COMPOSITE CONSTRUCTION SYSTEM FOR INTERNAL AND/OR EXTERNAL BUILDING-WALLS

FIELD AND BACKGROUND OF THE INVENTION

The invention concerns a prefabricated composite construction system for internal and/or external building walls and consists of:

a building panel for internal use of wooden material and a building panel for external use of a heat-insulating hard cellular material, one-piece spacers—arranged at a certain distance from each other and in rows which limit voids between the panels which can be filled with concrete—which are firmly fixed to the building panel for internal use by means of bondings and are connected with the building panel for external use, and steel lattices with steel lattice girders, lying on the building panel for internal use, which are provided in the voids between the spacers and extend in the concrete chuting direction.

The use of formwork blocks of STYROPOR, the chambers of which are filled with concrete, is already common practice. For the erection of an external wall, the formwork blocks are placed on top of each other in layers and plastered on both sides. Such a construction method is relatively costly. Because a considerable number of formwork blocks has to be at disposal and because they can only be produced in special forms, high production costs result, In addition, the interior surface of walls erected in this manner has to receive internal finish prior to wallpapering, the placing of wall tiles or the like.

At a known prefabricated composite construction system similar to the above mentioned one (DE-GM 93 13 091.0), the spacers which are formed of wood and/or plastic, are directly firmly fixed, by means of the bondings at their relevant bearing areas, to the building panel for external use consisting for example of barely inflammable polystyrene—high resistance foam and with the building panel for internal use which can consist also of gypsum material or asbestos cement, This known composite construction system can be produced at relatively low cost, it can be simply installed and the facade has to be treated only once with external finish or thin plastic finish thereby reducing the building costs considerably. Nevertheless, experinence has shown that the risk exists of damaging the budding panel for external use in the long term when high pressure is applied at points to the building panel for external use, consisting for example of STYROPOR, in the area of the in each case relatively small contact area between the building panel for external use and each spacer.

SUMMARY OF THE INVENTION

The invention is therefore based on the task to place at disposal a prefabricated composite construction system of the above mentioned type which—also in case that high pressure is applied at points—offers increased stability of the building panel for external use and altogether an increased bending tension strength whereby the advantages of simple installation, economical production, and the possibility of combining the prefabricated composite construction system without problems with relevant traditional floor and internal wall composite construction systems in accordance with DM-GM 93 13 091.0 shall be maintained.

The invention solves this task by providing a wooden material panel between the spacers—which are in each case arranged in one row—and the building panel for external use, whereby the wooden material panel is firmly fixed by means of the bondings to both, the building panel for external use and the bearing area of each of the allocated spacers, which are facing the building panel for external use, and by the wooden material panel having a length which is equal to the length or width of the building panels for internal and external use and a width which is at least double the size of the largest dimension of the bearing area of each spacer and by each steel lattice being firmly fixed to the building panel for internal use by means of many fixing elements which are in a distance to each other and grip in each case in a clamp-like manner over a part of the steel lattice.

In the preferred form, the bearing areas of each spacer, which are connected in each case by means of bonding agent with the building panel for internal use and the relevant wooden material panel being bonded to the building panel for external use, form in each case a bonding area of at least 45 $cm^2$. Preferred are at least 12 spacers, which are arranged in rows, per $m^2$ of the composite construction system. Three rows of spacers can be provided for every $m^2$ of the composite construction system, whereby the distance between neighbouring rows is in each case the same, with four spacers in each row, and the distance between neighbouring spacers of each row being the same in each case.

In the preferred form, the clamp-like fixing elements have a centered main part which grips round a steel girder or part of the steel lattice having the cross section form of a reversed U, the limbs of which at the lower end change in each case into a panel-like part being bent in an angle of 90° which is in each case lying flush on the building panel for internal use and has at least one punched hole for a fastening screw to be driven into the building panel for internal use, The fixing elements can be formed of sheet steel or be injection-moulded of a highly resistant plastic, The building panel for external use consists in the preferred form of a barely inflammable polystyrene high-resistance foam as, for example, STYROPOR. This material meets the fire protection regulations and has already been proven for a long time in practice, The required STYROPOR panels can be produced on a large scale in the desired dimensions without any problems. By varying the wall thickness, the building panel for external use can be adapted to varying conditions as regards the, heat insulation. It is also possible to produce the panel for external use of other cellular building materials.

In the preferred form, the building panel for internal use consists of a chip board without any formaldehyde with a high wooden portion. The building panels for internal use can, on the side facing residential areas, be wall-papered or have a textile wall coating so that an additional internal plastering layer is not necessary.

The spacers between the building panel for internal use and the wooden material panels connected in each case with the building panel for external use can also consist of STYROPOR elements and have square, circular, or rectangular bearing areas in order to form a permanent and firm bonding with the building panel for internal use and the relevant wooden material panel. The spacers can for example consist of double-T-profiles of STYROPOR with which an especially resistant bond can be achieved when a suitable bonding agent is used. Spacers of compressed old paper, wood fibres, glazed insulating pressboard, or grown wood are also suitable. Spacers of a barely inflammable polar plastic and a secondary material have also been proven, whereby care has to be taken that the used bonding agents enter into a resistant bond with both, this plastic and the relevant wooden material panel.

Commercially available bonding agents such as, for example, single-component bonding agents on polyurethane-basis which set with atmospheric oxygen have proven themselves, whereby the waiting time until the start of the setting process should be at least 45 minutes. But two-component bonding agents can also be used when the open waiting-times have been reached and no special conditions for setting are required. Nevertheless, the used bonding agents should well be able to fill gaps by means of enlarging their volume during the setting process and in addition, they should be easily measurable into exact doses, be environmentally compatible, and resistant against water and chemicals.

It surprisingly showed that the stability of the prefabricated composite construction system is increased in a satisfactory manner because of the specially dimensioned wooden material panels provided in each case between the spacers which are arranged in a row and the building panel for external use so that damages to it are practically excluded also in case of permament stresses at points on the outer surface of the building panel for external use, which is, for example, of STYROPOR. This increase in the stability of the prefabricated composite construction system in accordance with the invention has to be attributed at the same time to the improved bending tension strength of the prefabricated composite construction system which bending tension strength is created by the steel lattices which are firmly fixed with the special fixing elements on the building panel for internal use and extend in each case in concrete chuting direction in the voids between the spacers.

The prefabricated composite construction system can have appropriate recesses for the installation of windows and/or doors. Furthermore, prior to filling the voids with concrete, jacket tubes or jacket segments for house wiring cables can be arranged for the sanitary area and/or the electric power supply in the composite construction system. Usually, at least one metal profile with a stiffening effect is fixed in a manner so that it can be removed to the two external areas of the building panel for internal use and at this metal profile attachments for ropes are provided to make the safe transport of the prefabricated composite construction system by means of a crane possible at the time of installation.

BRIEF DESCRIPTION OF THE DRAWINGS

The invention is now individually described by means of the drawings. In these drawings:

Diagram 1 is a profile of a preferred model of the prefabricated composite construction system whereby the steel lattices have been deleted for a better overview, Diagram 2 is a section through the prefabricated composite construction system on a level which is vertical to the direction of placing the concrete, Diagram 3 is a profile of a clamp-like fixing element and Diagram 4 is a detailed sectional view of the prefabricated composite construction system which shows the fixing per steel girder on both sides of a STYROPOR spacer.

DETAILED DESCRIPTION

Figure 1:
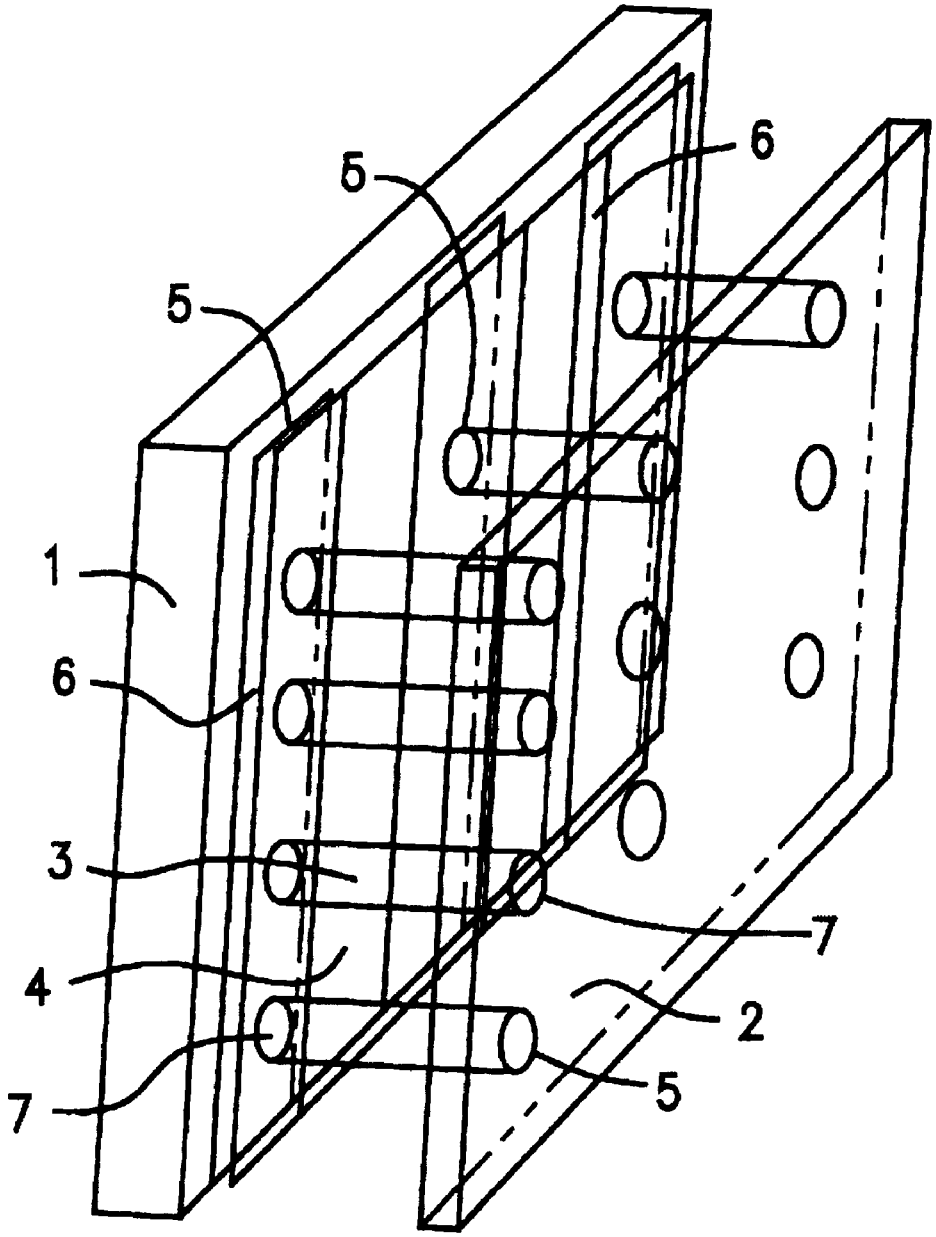
Figure 2:
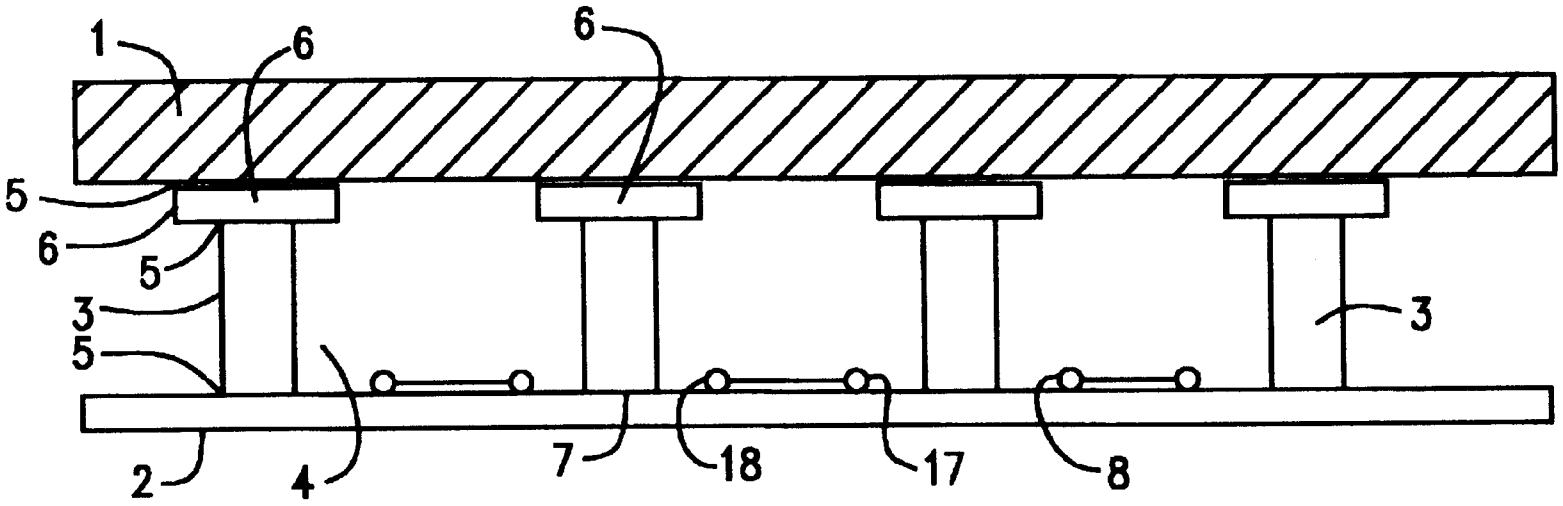
Figure 3:
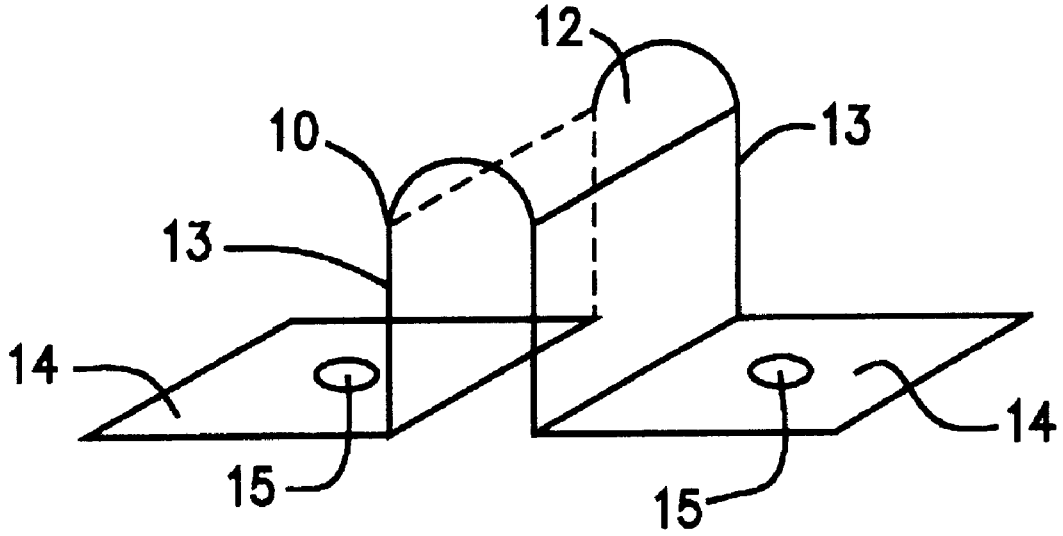
Figure 4:
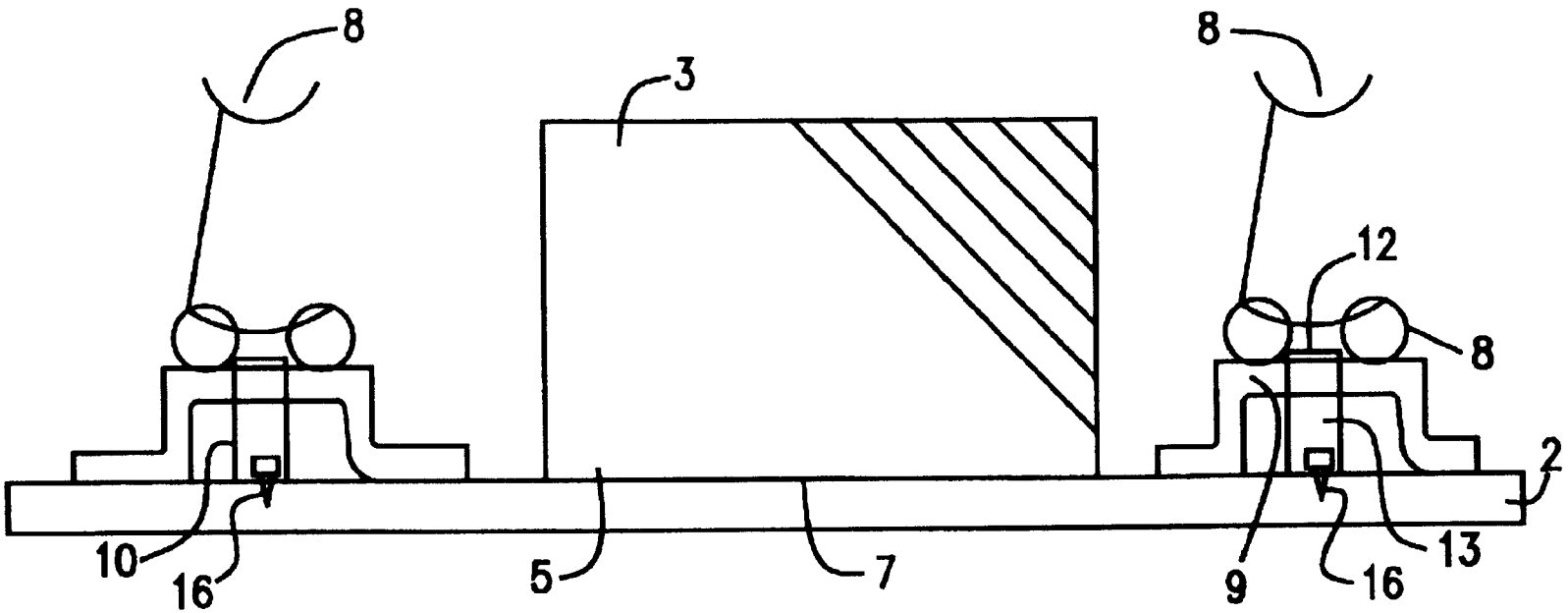

As shown in diagram 1, the prefabricated composite construction system has a building panel for external use 1 consisting of a heat-insulating hard cellular material such as STYROPOR and a building panel for internal use 2 formed of a wooden material which are arranged at a certain distance from each other. Between the panels 1 and 2 single-piece spacers 3 are provided which are arranged at a certain distance from each other and in rows and, in accordance with the preferred model according to diagram 1, per square meter of the prefabricated composition construction three rows of spacers 3, with the distance between their neighbouring rows being the same in each case, whereby in every row four spacers 3 are provides and the distance between neighbouring spacers 3 of each row is the same. The spacers 3 limit voids 4 to be filled with concrete between the panels 1 and 2.

Between the spacers 3 which are in each case arranged in a row and the building panel for external use 1, always one wooden material panel 6 is provided which is connected by means of a bond 5 with both: the building panel for external use 1 and the bearing area 7 of each of the allocated spacers 3 facing it in each case. With their opposite bearing area 7, the spacers 3 are in each case firmly fixed to the building panel for internal use 2 by means of additional bondings 5. The bearing areas 7 of each spacer 3, which bearing areas are in each case connected by means of a bonding agent with the building panel for internal use 2 and with the relevant wooden material panel 6, which is glued to the building panel for external use 1, form in each case a bonding area of at least 45 $cm^2$. Every wooden material panel 6 has a length and a width which is equal to the length or width of the building panels for internal and external use 2 or 1, which length or width is at least double the size than the largest dimension of the bearing area 7 of each spacer 3.

Diagram 2 shows that in the voids 4 between the spacers 3, steel lattices B with steel lattice girders 18 are provided in the voids which steel lattices extend in concrete chuting direction, lie on the building panel for internal use 2, and are firmly fixed on it. The firm fixing of every steel lattice 8 on the building panel for internal use 2 is provided, as can be taken from diagram 4, by many fixing elements 10 which are in a distance to each other and grip in each case in a clamp-like manner over a part 9 of the steel lattice 8 or a steel lattice girder 17, which is connected with the relevant steel lattice 8, and are fixed to the building panel for internal use 2.

Diagram 3 shows a preferred model of the clamp-like fixing elements 10 which in each case have a centered main part 12, gripping round a steel lattice girder 17 or a part 9 of the steel lattice 8 (diagram 4), with the cross-section form of a reversed U, the limbs of which 13 at the lower end change in each case into a panel-like part 14 bent in an angle of 90° which panel-like part is lying in each case flush on the building panel for internal use 2 and has at least one punched hole 15 for a fastening screw 16 (diagram 4) which is driven into the building panel for internal use 2. The fixing elements 10 can either be formed of sheet steel or be produced of an appropriate, highly resistant plastic in an injection moulding procedure.

What is claimed is:

1. Prefabricated composite construction system for internal and/or external building-walls, consisting of a building panel for internal use of wooden material and a building panel for external use of a heat-insulating hard cellular material, one-piece spacers, which are in a distance to each other and arranged in rows, limiting voids between the panels which can be filled with concrete and are, by means of bondings, firmly fixed to the building panel for internal use and which are connected with the building panel for external use and of steel lattices with steel lattice girders provided in the voids between the spacers which steel lattices extend in concrete chuting direction and lie on the building panel for internal use, characterized thereby that between the spacers (3) arranged in a row in each case and the building panel for external use (1) a wooden material panel (6) is provided which is firmly fixed by means of bondings (5) to both, the building panel for external use (1) and the bearing area (7) facing it of each of the allocated spacers (3) and which wooden material panel (6) has a length which is equal to the length or width of the building panels for internal and external use (2 or 1) and a width which is at least double the size of the largest dimension of the bearing area (7) of each spacer (3) and that every steel lattice (8) is firmly fixed to the building panel for internal use (2) by means of many fixing elements (10) which are in distance to each other and grip always in a clamp-like manner over a part (9) of the steel lattice (8).

2. Prefabricated composite construction system in accordance with claim 1, characterized thereby that the bearing areas (7) of each spacer (3) connected by means of bonding agents with the building panel for internal use (2) and the relevant wooden material panel (6), which is glued to the building panel for internal use (1), always form a bonding) area of at least 45 $cm^2$.

3. Prefabricated composite construction system in accordance with one of the claims 1 or 2, characterized thereby that at least 12 of the spacers (3) arranged in rows are provided per square meter composite construction system.

4. Prefabricated composite construction system in accordance with claim 3, characterized thereby that three rows of spacers (3) are provided per square meter composite construction system, with the distance between their neighbouring rows being the same in each case, whereby four spacers (3) are provided in each row and the distance between neighbouring spacers (3) of each row being the same in each case.

5. Prefabricated composite construction system in accordance with claim 1, characterized thereby that the clamp-like fixing elements (10) have always one centered main part (12), gripping round a steel girder or a part (9) of the steel lattice (8), with the cross-section form of a reversed U, the limbs of which (13) change, at the lower end, in each case into one panel-like part (14) which is bent in an angle of 90° and always lies flush on the building panel for internal use (2) and has at least one punched hole (15) for a fastening screw (16) which has been driven into the building panel for internal use (2).

6. Prefabricated composite construction system in accordance with claim 1, characterized thereby that the fixing elements (10) are formed of sheet steel.

7. Prefabricated composite construction system in accordance with claim 5, characterized thereby that the fixing elements (10) are injection moulded of resistant plastic.

* * * * *